US006626054B2

(12) United States Patent
Chinery

(10) Patent No.: US 6,626,054 B2
(45) Date of Patent: Sep. 30, 2003

(54) SWASHPLATE DESIGN

(76) Inventor: David Chinery, 251 Station Road, Hayes, Middx (GB), UB3 4JD ( * ) Notice: Subject to any disclaimer, the term of this patent is extended or adjusted under 35 U.S.C. 154(b) by 0 days.

(21) Appl. No.: 09/863,106

(22) Filed: May 22, 2001

(65) Prior Publication Data

US 2002/0174734 A1 Nov. 28, 2002

(51) Int. Cl.[7] ..... F02B 75/32; F02B 75/26; F01B 9/04

(52) U.S. Cl. ..... 74/60; 74/22 R; 74/117

(58) Field of Search ..... 74/22 R, 22 A, 74/60, 117, 119, 124, 413, 414; 417/222.1

(56) References Cited

U.S. PATENT DOCUMENTS

| | | | | | |
|---|---|---|---|---|---|
| 546,762 | A | * | 9/1895 | Gessner | 26/100 |
| 960,575 | A | * | 6/1910 | Negley | 74/60 |
| 1,788,609 | A | * | 1/1931 | Andrews | 123/56.4 |
| 1,945,391 | A | * | 1/1934 | Benedek | 74/22 R |
| 2,141,935 | A | * | 12/1938 | Rose | 184/8 |
| 2,401,433 | A | * | 6/1946 | Michell | 74/60 |
| 2,486,690 | A | * | 11/1949 | Tipton | 74/22 R |
| 3,276,276 | A | * | 10/1966 | Dangauthier | 74/60 |
| 4,142,452 | A | | 3/1979 | Forster et al. | 91/506 |
| 4,513,630 | A | * | 4/1985 | Pere et al. | 417/222.1 |
| 4,858,480 | A | * | 8/1989 | Rohde et al. | 417/222.1 |
| 5,024,143 | A | * | 6/1991 | Schniederjan | 74/60 |

FOREIGN PATENT DOCUMENTS

| | | | |
|---|---|---|---|
| EP | 0019557 | 5/1980 | F02B/75/32 |
| WO | WO 95/08697 | 3/1995 | F01B/3/02 |

* cited by examiner

*Primary Examiner*—Chong H. Kim
*Assistant Examiner*—Colby Hansen
(74) *Attorney, Agent, or Firm*—Brown & Michaels, PC

(57) ABSTRACT

A rolling element or ball swashplate has a part-spherical surface covered in latitudinal grooves and ridges, in cross-section resembling parts of a spur gear wheel. The ball is mounted on a well-known rolling element bearing on its polar axis. The bearing and ball are carried on shaft so that the axis is at an angle to that of the shaft. Rotation of the latter causes the ball to precess. Cylindrical racks have circumferential teeth along their length (equivalent to a screw thread with a zero helix angle) which mesh with the ridges and grooves on the spherical ball surface. The racks may slide on rods, or may commonly form part of a larger component such as an hydraulic piston which itself moves bodily. As shaft rotates, the meshing ridges and teeth cause linear motion of the racks, or vice versa. At any time, the ball and racks may rotate about their respective axes, moving the meshing contact point to different parts of the same teeth and distributing the wear evenly.

13 Claims, 2 Drawing Sheets

SWASHPLATE DESIGN

BACKGROUND OF THE INVENTION

1. Field of the Invention

The invention relates to a motion and power transfer arrangement. More particularly, the invention pertains to an improvement in swashplate design.

2. Description of Related Art

Swashplates are well known and have been used for many years in such applications as hydraulic pump motors. They are used to transfer motion between a rotating shaft and one or more translating components reciprocating on axes parallel to the shaft and disposed around it. The conventional design often has many sliding, rotating and translating parts, mechanical efficiency may be low and wear rates may be high.

A basic swashplate typically consists of a disc mounted at an inclined angle on a shaft. Rotating the shaft will cause the edges of the disc to precess in a direction parallel to the shaft axis in simple harmonic motion compared to a fixed point in space. Mechanical connection may be made by a variety of means to interact with pistons, shuttles or other components, which are required to reciprocate. For these components to interact with the swashplate and transfer forces one way or the other, three relative motions must be accommodated by sliding and/or rotating mechanical connections.

The first of these is the rotation of the disc itself which may be accommodated by slipper plates sliding on the face of the disc. Alternatively, the disc may be mounted on a skewed bearing so that it stays rotationally stationary whilst precessing about its center point. The precessive motion is similar to the final motion of a coin spun on a flat surface just before it lies flat and stops.

The second factor is the arcuate motion of a point on the rim of the disc. As the disc precesses, any point on the rim will describe part of a spherical surface. In the case of the alternative above, where the disc does not rotate, a reference point will describe an arc about an axis normal to the shaft axis. Thus its radial distance from the shaft axis will vary. If we intend to connect this motion to a part sliding parallel to the shaft axis and at a constant distance, we must accommodate the change in distance between the disc edge all the sliding axis due to this arcuate motion of the rim of the disc.

The third motion is the 'skew" angle between the plane of the disc and the axis of the reciprocating part due to the inclination of the disc. As the disc precesses, the orientation of the angle will change. At one extreme of reciprocating movement the radial angle is greatest whilst the tangential angle is normal to the sliding axis. At the mid-stroke position, the radial angle is normal and the tangential angle is at a maximum corresponding to the disc inclination.

To summarize, in order to transfer drive from the disc to the parallel reciprocating part, one must accommodate disc rotation, compensate for arcuate motion and arrange for the connection to allow angular displacement in three axes simultaneously. The more efficient existing solutions are complex and expensive to manufacture. Lower cost ones utilize crude, sliding frictional contact, which has severe penalties in wear and mechanical efficiency.

SUMMARY OF THE INVENTION

It is the aim of the present invention to eliminate the problems associated with current swashplate designs. The present invention provides a mechanism acting as a swashplate, which has few separate parts and is easy to manufacture.

The present invention transmits power and motion between the parts by rolling and meshing contact between the parts. This provides low wear and mechanical efficiency. The latter attribute is especially valuable when used in variable stroke hydraulic motors, where it will dramatically improve the mechanical efficiency at low swashplate inclination angles. A mechanism according to the present invention is very simple mechanically, needing a minimum number of easily mass-produced parts.

The arrangement of the present invention is very compact compared to existing designs and occupies a minimal swept void volume to accommodate it. This is an advantage over existing solutions in reducing the overall size and weight of machines using this invention.

Accordingly, in one embodiment of the invention, there is provided a rolling element swashplate comprising a part-spherical toothed swash-ball and one or more cylindrical racks meshing with the teeth on the ball. The ball is carried on a main shaft by a well-known rolling element bearing, which is mounted at an inclination to the shaft axis by an angled boss. This angle may be fixed or adjustable, for instance to vary piston stroke in an hydraulic machine. Rotation of the shaft will cause the equatorial plane of the ball to precess as described above, whatever the relative rotational position of the ball about its bearing.

The outer surface of the ball resembles a globe with the polar areas removed. This surface is covered with ridges and grooves that run around the ball parallel to the equatorial plane and form the teeth. The geometric form of the surface can be described as a solid of revolution derived by rotating a gearwheel with conventional or modified involute teeth about an axis across its diameter.

Viewed in cross-section the ball rocks about its center as the shaft is rotated, from maximum inclination one way to the other extreme and back. Motion of the teeth thus resembles a spur gear oscillating about its center and a rotational mid-point.

The reciprocating part slides along a fixed axis parallel to the shaft axis and carries a cylindrical rack rotatable about the part's axis. The cylindrical rack has teeth running round it normal to the axis, that match those on the ball and mesh with them. As the main shaft turns, the point on the ball nearest to the parallel part "rocks" in section as described above, the mesh of the teeth driving the part in simple harmonic motion.

When the ball is in the mid-position and the rack and part are at mid-stroke, the tangential skew angle will be at a maximum and equal to the "disc inclination" or "swash angle". In order to accommodate this skew, the profile of the teeth on the rack is modified progressively along its length to allow clearance for the teeth to mesh obliquely as the rack passes the mid-point.

DETAILED DESCRIPTION OF THE INVENTION

Figure 1:
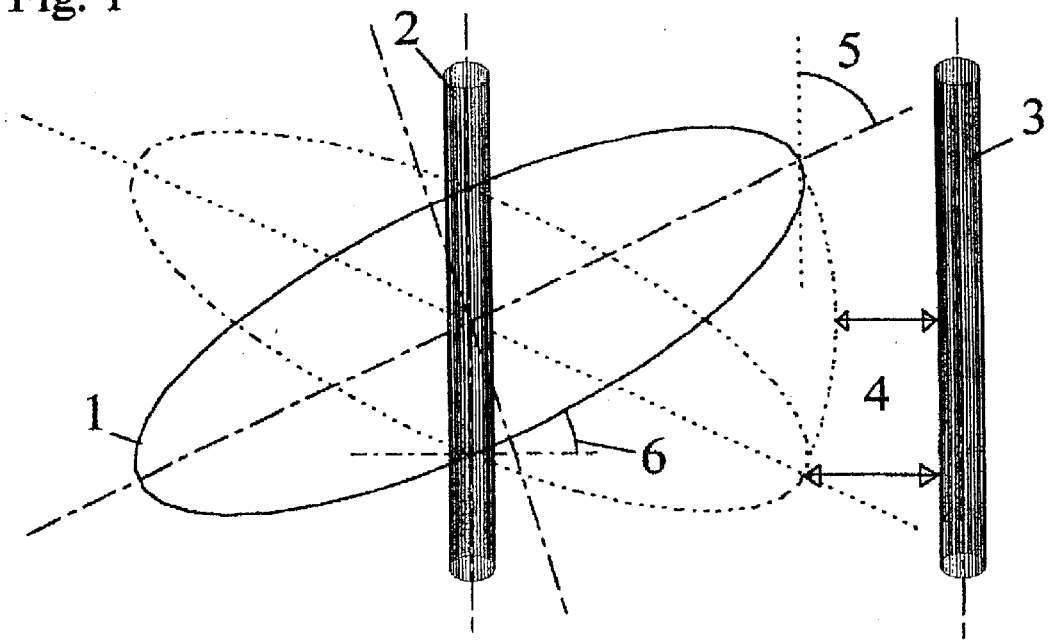
FIG. 1 illustrates the geometry of a simple disc swashplate interacting with parts parallel to the axis of the swashplate shaft.

Referring to FIG. 1, there is illustrated the geometry of a simple disc swashplate and its interaction with a part parallel to it shaft. The disc 1 is mounted on a shaft 2 at an inclined angle 6 to a plane parallel to the shaft. A part 3 is located close to the edge of the disc with its axis parallel to the shaft.

Rotation of the shaft 2 causes the angled disc to rotate with it. Owing to the angularity of the disc, the edge of the disc nearest to 3 appears to move up and down over the range shown by the dotted alternative position of the disc. This cyclic motion parallel to the axis of shaft 2 can used to reciprocate a part (not shown) sliding along part 3. However, in order to connect this motion, a mechanism must accommodate four simultaneous variations.

1. The rotation of the disc viewed along the axis of 2 must be allowed for, either by sliding contact at its rim or by a rotary bearing at the center of the disc and disposed at the same inclination angle to the shaft 2. This latter solution is well known and is not claimed.

2. A further problem is the apparent arcuate motion of the disc edge, which causes the distance between it and part 3 to vary, as shown at 4. This can be accommodated by a mechanism with a radial sliding motion.

3. The radial angle 5 varies cyclically between positive and negative angles equal to the disc inclination.

4. The tangential angle 6 also varies over the same range. A mechanism with two degrees of angular freedom is required to allow for these changes. Conventional designs of swashplate often require many sliding and rotating parts to overcome these geometrical difficulties, and can be complicated and expensive to manufacture. The simultaneous sliding and rotating motions may cause high frictional losses, and the mechanism may require a large space in a machine to accommodate it.

Figure 2:
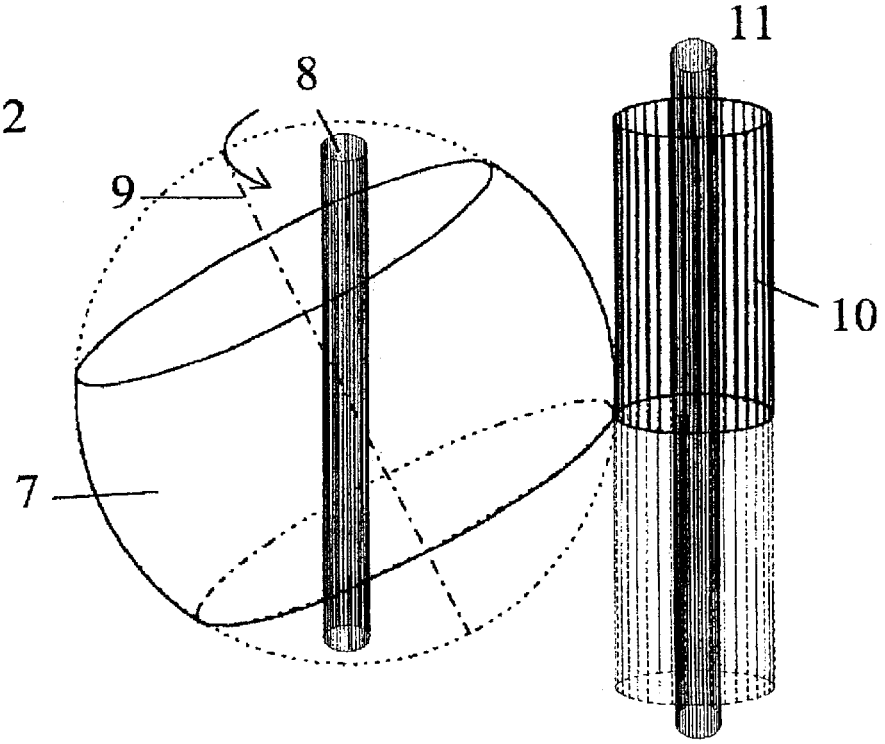
FIG. 2 illustrates the basic geometry of a ball swashplate according to the present invention, which is also interacting with parts parallel to the main shaft.

FIG. 2 shows the corresponding basic geometry of a ball swashplate which solves all of the above problems. A part-spherical member (the "ball") 7 is mounted to freely rotate about its axis 9, which is fixed at an angle oil shaft 8 and rotates with the latter. This causes the equatorial plane of the ball to precess in the same manner as the disc 1 in FIG. 1. It may be regarded as a "disc" with significant axial thickness.

Part 10 is a cylindrical body in non-sliding contact with a point on the spherical surface of the ball, and able to rotate about and slide along guide-shaft 11. The latter is parallel to 8 and at a fixed distance from it. If shaft 8 is rotated, the axis 9 precesses with it. The part of the ball in contact with 10 appears to move up and down over a range equal to double the disc inclination (or '"swash") angle, sliding part 10 along its axis cyclically in simple harmonic motion.

This geometry allows perfect transfer of motion between the rotation of shaft 8 and the linear reciprocation of part 10, but depends on the theoretical non-sliding contact between the surfaces of parts 7 and 10.

Figure 3:
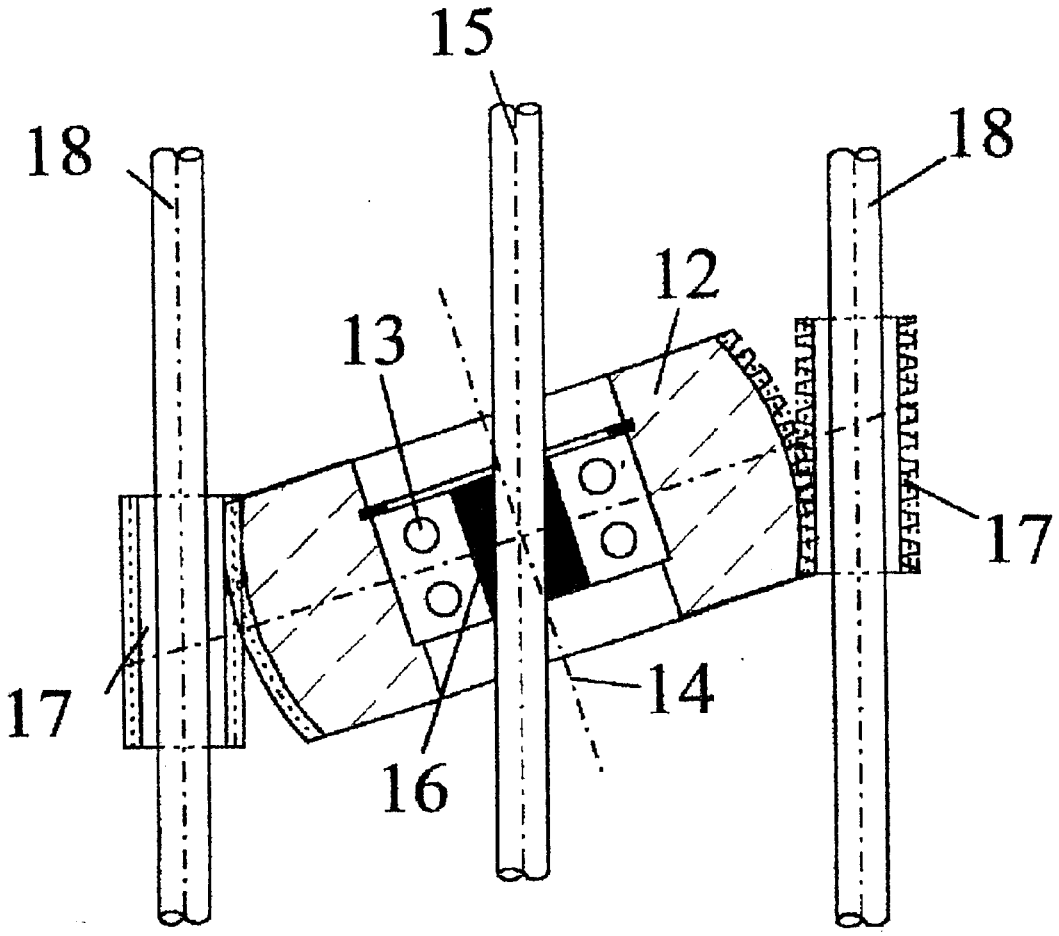
FIG. 3 shows a practical embodiment of the invention, where a ball swashplate interacts with cylindrical racks in a machine.

FIG. 3 shows a practical embodiment of the principle. The mechanism according to the present Invention is shown in sectional view at one extreme position of ball inclination. Ball 12 runs on a well-known rotary bearing 13, and has numerous grooves on its spherical surface resembling gear teeth in sectional view. The spherical surface is a solid of revolution of part of a gearwheel about a diameter of that gearwheel. This can have conventional involute-type teeth or special tooth forms can be used, which may vary along the latitudinal length of the toothed area. The grooves and teeth occupy the entire spherical surface of the ball resembling lines of latitude with respect the ball's axis 14.

The non-rotating part of the bearing 13 is mounted at an angle on shaft 15 by boss 16, which is fixed to the shaft and rotates with it. This angle between the axes of 14 and 15 may be fixed, or variable between zero and a maximum value.

One or more cylindrical racks 17 are mounted on an equal number of shafts 18, on which they can slide and rotate freely. The cylindrical racks have teeth disposed along the length of their cylindrical surface, which mesh with those on the ball. The teeth are cut separately around the circumference of the cylindrical surface and are normal to its axis. The tooth form and pitch of the cylindrical racks may vary along their axial length.

Rotation of shaft 15 will cause the ball to precess about its center, causing the parts nearest to racks 17 to appear to oscillate. Racks 17 will thus reciprocate in mesh with the teeth on the ball. Motion and power can be transferred between them in either direction. If the racks 17 are fixed axially on shafts 18 but allowed to rotate freely, the latter will be driven to oscillate along their axes and can be connected to pistons or other components to interact with pressure energy in a pump, motor, engine or other class of machine. Alternatively the rack teeth may form an integral part of the pistons which can themselves rotate about their axis.

Because the teeth on the meshing parts are normal to their respective rotational axes, rotational motion or changes in rotational orientation of 12 and 16 about their axes do not affect the action of the mechanism. In practice, tribological and dynamic forces should cause both to rotate slowly about these axes in continuous use, constantly changing the contact points and reducing wear and frictional losses.

This mechanism addresses all the geometrical problems illustrated in FIG. 1, except for the tangential angle 6. When the ball of the present Figure is at the extreme position shown, the part of the ball teeth in mesh with the rack teeth will be parallel to them. However, at the mid-position, the ball teeth will be skewed at the disc inclination angle with respect to the rack teeth. This skew angle will vary cyclically with rotation of shaft 15 between positive and negative angles equal to the disc inclination. Because this variation is constant every cycle, the resulting skewed mesh can be accommodated by varying the tooth form of either or both ball and racks whilst keeping the pitch constant or varying along the axial length. For manufacturing reasons, it may be preferable to keep the ball teeth constant and vary those of the racks, however, modem CNC manufacturing techniques can produce any required form. The amount of variation depends on the disc inclination angle.

In machines using swashplates, it is common for the disc angle to be adjustable in use, for instance to change the stroke of pistons. This principle can be applied to the present invention, where boss 16 may be designed to vary the disc inclination in response to a control means. These are well known and not claimed.

Where such a variation occurs, the variation in the rack tooth form must accommodate the maximum disc inclination and tooth mesh '"skew". When the disc inclination is reduced from this maximum figure, the skew angle will be reduced, leaving axial clearance in the tooth mesh at mid-stroke. Whilst this may cause chatter or other problems in light load operation, in practice, the tooth flanks will normally be in contact at the start of each stroke and should remain so under axial loading and inertia until the stroke is completed.

Because of the motion of the combined parts, the volume inside a machine that will accommodate the mechanism its operating envelope is minimal, allowing the machine to be smaller and lighter and of non-circular cross-section if desired.

Existing hydraulic and hydrostatic machines using a swashplate usually have the piston axes (parts 18 in FIG. 3) disposed radially and equi-spaced around the main shaft axis (15) at a constant radius. This results in machines with a substantially circular cross-sectional envelope normal to axis 15. For reasons of compactness or other geometric constraints this circular form may be undesirable. The present invention enables variation after radial distance between 15 and 18 to be varied by changing only the pitch circle diameter of the cylindrical racks 17. This would allow maximum utilization of space within a non-circular envelope, for instance a rectangle.

This ability to vary the radial offset will also allow pistons and cylinders of different individual diameters (for instance in a compound gas expansion or compression machine) to be accommodated efficiently within any given envelope.

Use of a ball 12 that may be asymmetric about its equatorial plane will allow the mechanism of the present invention to transfer motion to parts moving on axes not parallel to the main shaft axis 15, unlike those shown in FIG. 3. For instance, axes 18 may be disposed about 15 as straight lines on the imaginary surface of a cone generated about axis 15. This may be desirable for reasons of design of the complete machine incorporating the present invention. The angularity of the axis of such parts may be fixed or variable as required, the tooth forms on the ball and racks being designed specifically to accommodate the required geometry.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A swashplate mechanism comprising:

a) a shaft having an axis of rotation;

b) at least one sliding cylinder member which is free to move in a reciprocating linear motion having a contact face; and c) a part-spherical member, having arcuate sides, operatively connected to the shaft such that the part-spherical member has an axis of rotation at an angle to the axis of rotation of the shaft, and has precessional motion as the shaft rotates, and the arcuate sides of the part-spherical member contact the contact face of the sliding cylinder member in such a manner that rotation of the shaft is driveably coupled to reciprocating linear motion of the sliding cylinder member where in the at least one sliding cylinder member and the part-spherical member can rotate about their axes of rotation to vary a contact point.

2. The swashplate mechanism of claim 1 where the part-spherical member has its contact surface covered with rows of ridges and grooves forming circumferential teeth.

3. The swashplate mechanism of claim 2 wherein the shape of the ridges and grooves forming teeth on the part spherical member varies along the axial length of the spherical member to allow continuous adjustment of the swash angle whilst in use.

4. The swashplate mechanism of claim 2 wherein the shape of the ridges and grooves forming teeth varies with respect to the relative position of the tooth on the part spherical member.

5. The swashplate mechanism of claim 2 wherein the at least one sliding cylinder member has its contact surface covered with rows of ridges and grooves forming circumferential teeth has circumferential teeth that mesh with the teeth on the part spherical member.

6. The swashplate mechanism of claim 5 wherein the shape of the ridges and grooves forming teeth on the at least one sliding cylinder member varies along the axial length of the sliding cylinder member to accommodate cyclic variations in the skew angle of the mesh between the part-spherical member and the sliding cylinder member.

7. The swashplate mechanism of claim 5 wherein the shape of the ridges and grooves forming teeth varies along the axial length of the at least one sliding cylinder member to allow continuous adjustment of the swash angle whilst in use.

8. The swashplate mechanism of claim 2 wherein the shape of the ridges and grooves forming teeth on the part-spherical member varies along the axial length of the part-spherical member to accommodate cyclic variations in the skew angle of the mesh between the part-spherical member and the sliding cylinder member.

9. The swashplate mechanism of claim 1 wherein the angle between the axis of rotation of the part-spherical member and the axis of the shaft is fixed and where the part-spherical member is free to rotate about the axis of rotation of the part-spherical member.

10. The swashplate mechanism of claim 1 wherein the at least one sliding cylinder member is driveably coupled to the part spherical member by rolling and meshing contact only, thereby reducing wear and friction.

11. The swashplate mechanism of claim 1 wherein the at least one sliding cylinder member is free to move in a reciprocating linear motion on an axis parallel to the shaft axis.

12. The swashplate mechanism of claim 1 wherein the part-spherical member is asymmetric about its equatorial plane and at least one the sliding cylinder member is free to move in a reciprocating linear motion on an axis that is not parallel to the shaft axis.

13. The swashplate mechanism of claim 1, wherein the angle between the axis of rotation of the part-spherical member and the axis of the shaft is variable and where the part spherical member is free to rotate about the axis of rotation of the part-spherical member.

* * * * *